US010244582B2

(12) United States Patent
Carenza

(10) Patent No.: US 10,244,582 B2
(45) Date of Patent: Mar. 26, 2019

(54) SELF-REGULATING DUAL HEATING LEVEL HEATING ELEMENT

(71) Applicant: IEE International Electronics & Engineering S.A., Echternach (LU)

(72) Inventor: Pino Giuseppe Carenza, Luxembourg (LU)

(73) Assignee: IEE INTERNATIONAL ELECTRONICS & ENGINEERING S.A., Echternach (LU)

( * ) Notice: Subject to any disclaimer, the term of this patent is extended or adjusted under 35 U.S.C. 154(b) by 0 days.

(21) Appl. No.: 15/522,695

(22) PCT Filed: Oct. 22, 2015

(86) PCT No.: PCT/EP2015/074548
§ 371 (c)(1),
(2) Date: Apr. 27, 2017

(87) PCT Pub. No.: WO2016/066533
PCT Pub. Date: May 6, 2016

(65) Prior Publication Data

US 2017/0339748 A1 Nov. 23, 2017

(30) Foreign Application Priority Data

Oct. 27, 2014 (LU) ..... 92 587

(51) Int. Cl.
*H05B 1/02* (2006.01)
*H05B 3/34* (2006.01)

(52) U.S. Cl.
CPC ..... *H05B 1/0238* (2013.01); *H05B 3/34* (2013.01); *H05B 2203/003* (2013.01);
(Continued)

(58) Field of Classification Search
CPC ..... H05B 1/0238; H05B 3/12; H05B 3/26; H05B 3/34; H05B 3/16; H05B 2203/011;
(Continued)

(56) References Cited

U.S. PATENT DOCUMENTS 3,557,532 A * 1/1971 Broerman ..... G01N 30/30 210/656
4,574,188 A * 3/1986 Midgley ..... H05B 3/146 219/505

(Continued)

FOREIGN PATENT DOCUMENTS

| | | |
|---|---|---|
| EP | 0668646 A2 | 8/1995 |
| FR | 2809582 A1 | 11/2001 |
| GB | 2028608 A | 3/1980 |

OTHER PUBLICATIONS

International Search Report for International application No. PCT/EP2015/074548, dated Jan. 19, 2016, 3 pages.

(Continued)

*Primary Examiner* — Mark Paschall
(74) *Attorney, Agent, or Firm* — Reising Ethington P.C.

(57) ABSTRACT

A heater element having an electrically insulating substrate, a buss layer made of a conductive material, and a resistive layer that includes a first patch of a first resistive material. The first buss layer has a first buss and a second buss extending from terminals of the heater element to a heating area of the heater element. The first resistive material is applied in a first selected location in the heating area so as to provide electrical communication between the first buss and the second buss and to enable an electrical current to flow through the first resistive material. The resistive layer includes a second patch of a second resistive material. The second patch is applied in a second selected location in the heating area so as to provide electrical communication between the first buss and the second buss, the second (Continued)

selected location being different from the first selected location.

7 Claims, 1 Drawing Sheet

(52) U.S. Cl.
CPC .. *H05B 2203/011* (2013.01); *H05B 2203/013* (2013.01); *H05B 2203/02* (2013.01); *H05B 2203/029* (2013.01); *H05B 2203/037* (2013.01)

(58) Field of Classification Search
CPC ..... H05B 2203/012; H05B 2203/02; H05B 2203/029; H05B 2203/037; H05B 2203/0288; H05B 2203/01272
USPC ..... 219/504, 505, 211, 212, 489, 508, 485, 219/483
See application file for complete search history.

(56) References Cited

U.S. PATENT DOCUMENTS 4,705,935 A 11/1987 Traffanstedt et al.
2009/0213521 A1* 8/2009 Bedingfield ..... A61M 5/445 361/194

OTHER PUBLICATIONS

Written Opinion for International application No. PCT/EP2015/074548, dated Jan. 19, 2016, 6 pages.

* cited by examiner

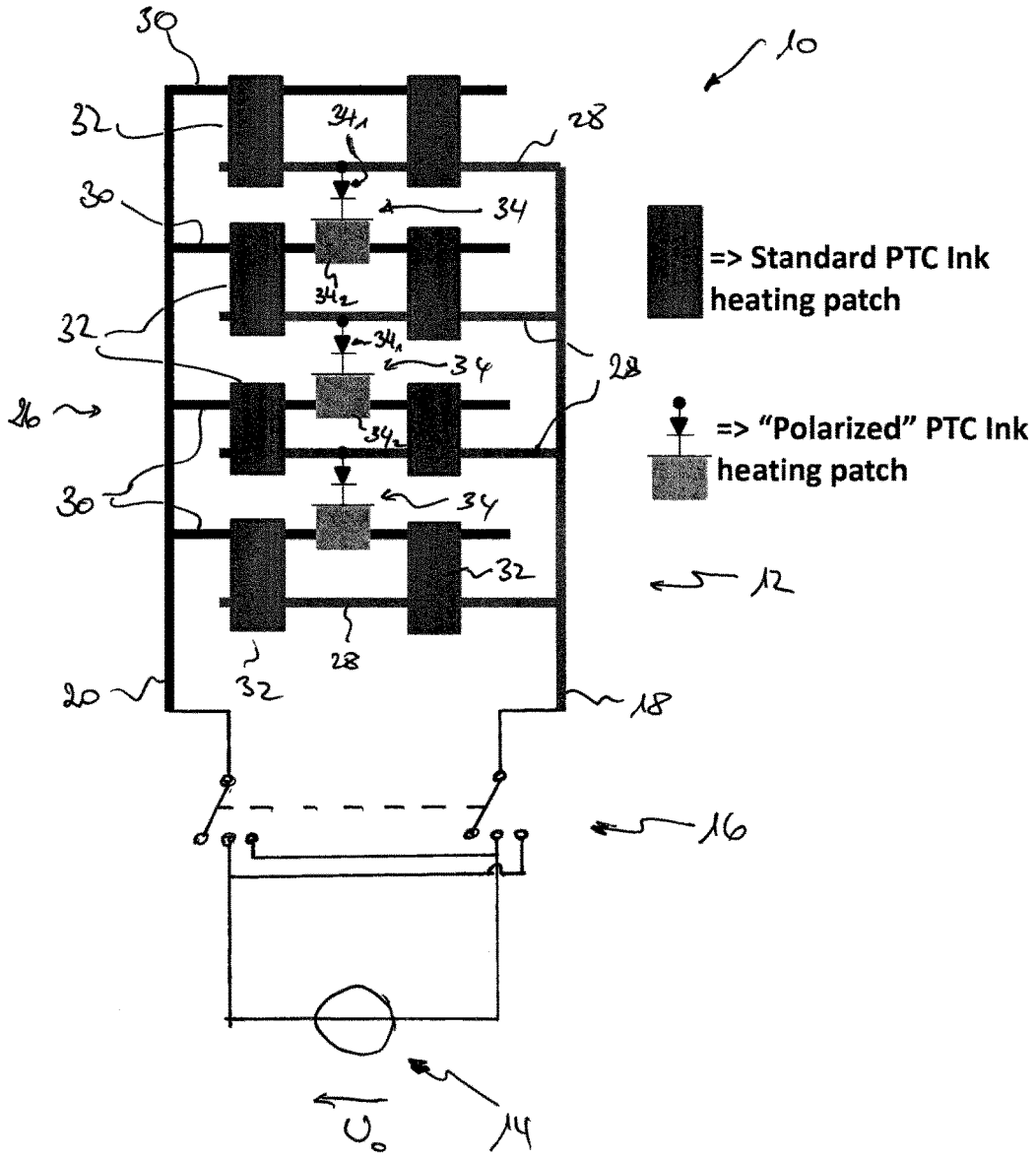
=> Standard PTC Ink heating patch
=> "Polarized" PTC Ink heating patch

SELF-REGULATING DUAL HEATING LEVEL HEATING ELEMENT

TECHNICAL FIELD

The present invention generally relates to a heating device with multiple power levels and more particularly to a self-regulating PTC (Positive Temperature Coefficient) heating element with two power levels and without electronic power control. Such heater devices are for instance used in power controlled heater applications in the automotive field, such as e.g. seat-heater, interior/panel heater, etc., or in heater devices for consumer products.

BACKGROUND ART

Sheet-type ohmic heating elements have the advantage of being flexible so that they can be mounted on a surface of any virtually any shape.

A PTC material is a material the specific electric resistance of which rises with increasing temperature. The temperature coefficient indicates the increase in resistance per unit of temperature increase. A heating element having such a PTC characteristic self-regulates the heat that it emits. As an electrical current is caused to flow across the heating element, the temperature of the heating element rises. Due to the increasing resistance, the electrical current is reduced until equilibrium is reached.

In general, power controlled heating devices, such as e.g. seat-heater (SH) devices, require electronic control units in order to establish a set of well-defined heating power levels. In such cases heating control is either done directly via thermostat elements in the supply circuit of the actual heating element or by using a pulsing electronics which regulates the mean heater current by varying the relative ON/OFF time interval of the power supply.

SUMMARY

It is an object of the present invention to provide for an improved heating device which provides dual power levels without the necessity of a complex electronic power control. This object may be achieved by a heating element as claimed in claim 1.

In accordance with an aspect of the invention, there is provided a heater element for generating heat when connected to an electrical power source. The heater element comprises an electrically insulating substrate, a buss layer made of a conductive material applied to said substrate, said first buss layer comprising a first buss and a second buss extending from respective first and second terminals in a terminal area of said heater element to a heating area of said heater element, and a resistive layer comprising at least one first patch of a first resistive material. The at least one first patch of said first resistive material is applied in a first selected location in said heating area such as to provide electrical communication between said first buss and said second buss and to enable an electrical current to flow through said first resistive material if a voltage gradient of a first polarity is applied across said first and second busses. According to the invention the resistive layer comprises at least one second patch of a second resistive material, said at least one second patch of said second resistive material being applied in a second selected location in said heating area such as to provide electrical communication between said first buss and said second buss, said second selected location being different from said first selected location. The at least one second patch of said second resistive material is furthermore configured as a polarized patch so as to enable an electrical current to flow through said second resistive material if a voltage gradient of a second polarity opposite to said first polarity is applied across said first and second busses and to block an electrical current to flow through said second resistive material if a voltage gradient of said first polarity is applied across said first and second busses.

With the above heater element a simple heating element with two power levels and without electronic power control is easily achieved. If the heater element is operated with a voltage gradient of the first polarity, the second patch of said second resistive material is non-conducting. It follows that in this operation mode, only the "standard" first patch of a first resistive material contributes to the generation of heat of the heater element. If the polarity is reversed, i.e. if a voltage gradient of the second polarity is applied across the first and second busses, the polarized configuration of the second patch of said second resistive material enables an electrical current flow across the resistive material and thus this second material contributes to the heating power. In this operational mode both the first and the second resistive PTC material contribute to the generation of heat and in this operational mode the heater element emits the maximum heating power.

It follows that the heater element enables an easy implementation of three different states: OFF, if no voltage gradient is applied, LOW temp if a voltage gradient of the first polarity is applied and HIGH temp is the polarity is reversed. It will be noted that the heating levels at LOW or HIGH may be achieved by design of the patches of first and second resistive material, e.g. the ratio between the surface of the second resistive material versus the surface of the first resistive material.

In a preferred embodiment the at least one second patch of said second resistive material being configured as a polarized patch comprises at least one diode being connected in a series connection with said resistive material between said first buss and said second buss. This means that the "Polarized" heating element can be easily realized by connecting in series a semiconductor to a standard heating element. The semiconductor diode could e.g. be screen printed or crimped to the bus lines or "pick and placed" on the bus lines.

In preferred embodiments of the invention, said first resistive material has a first positive temperature coefficient (PTC) and/or said second resistive material has a second positive temperature coefficient (PTC). Such an embodiment provides for a self-regulating heater element, i.e. a heater element which does not require a complex electronic power control unit.

A PTC material is a material the specific electric resistance of which rises with increasing temperature. The temperature coefficient indicates the increase in resistance per unit of temperature increase. A heating element having such a PTC characteristic self-regulates the heat that it emits. As an electrical current is caused to flow across the heating element, the temperature of the heating element rises. Due to the increasing resistance, the electrical current is reduced until equilibrium is reached. It follows that the above disclosed heater element is self-regulating and does not require a complex electronic power control.

It should be noted that the first positive temperature coefficient (PTC) of the first resistive material may be equal to the second positive temperature coefficient (PTC) of said second resistive material. The first and second resistive material may e.g. be the same material. Alternatively the first resistive material may be different from the second resistive material and/or the first resistive material may be different from the second positive temperature coefficient.

In a preferred embodiment of the invention, said first buss and said second buss extend generally along opposite sides of said heating area and a number of alternating conductive lines are electrically connected to opposite said first and second busses and extend between said first and second busses. The at least one first patch of said first resistive material and/or said at least one second patch of said second resistive material is/are then preferably applied in said heating area of said heater element such as to provide electrical communication between at least selected ones of said alternating conductive lines.

In a possible embodiment, the resistive layer comprises a plurality of first patches of said first resistive material and/or a plurality of second patches of said second resistive material and said plurality of first patches and/or said plurality of second patches is/are applied in said heating area of said heater element in such a way that said patches provide electrical communication between said first buss and said second buss. The patches may have the same size or the patches may be of different size. The power levels associated with the LOW and HIGH settings may in this case be adapted by the size of the individual patches of the first material and the second material and or by the ration of the number of patches of first material to the number of patches of second material or the like.

In one aspect of the present invention, an electrical heater comprises a heater element as disclosed hereinabove and an electrical power source operatively connectable to said first and second terminals of said first and second busses for applying a voltage gradient across said first and second busses. The electrical power source is preferably configured for operating in a first mode in which a voltage gradient of a first polarity is applied across said first and second busses and a second mode in which a voltage gradient of a second polarity opposite to said first polarity is applied across said first and second busses.

In another embodiment, the electrical heater comprises a heater element as disclosed hereinabove and an electrical power source operatively connectable to said first and second terminals of said first and second busses for applying a voltage gradient across said first and second busses and a switching element configured for reversing a polarity of said voltage gradient across said first and second busses.

BRIEF DESCRIPTION OF THE DRAWINGS

Further details and advantages of the present invention will be apparent from the following detailed description of a not limiting embodiment with reference to the attached FIG. 1 which is a schematic circuit diagram of an electrical heater according to a preferred embodiment of the invention.

DESCRIPTION OF PREFERRED EMBODIMENTS

FIG. 1 shows a schematic circuit diagram of an electrical heater 10. The heater comprises a heater element 12 which is connectable to an electrical power source 14 via switch 16.

The heater element 12 comprises a buss layer made of a conductive material applied to a foil type substrate (not shown). The buss layer comprises a first buss 18 and a second buss 20 extending from respective first and second terminals 22 and 24 in a terminal area of the heater element to a heating area 26.

First buss 18 and said second buss 20 extend generally along opposite sides of said heating area 26. A number of alternating conductive lines 28 and 30 are electrically connected to opposite said first and second busses 18 and 20 and extending between said first and second busses.

A resistive layer comprises a plurality of first individual patches 32 applied onto the substrate and onto selective conductive lines such as to provide electrical communication between at least selected ones of said alternating conductive lines and thereby between said first and second bus. It will be noted that while in the embodiment of FIG. 1 the different first patches 32 have the same shape and size, this is not a requirement for the heater element 12. Indeed the different patches could as well have different sizes or different shapes.

First resistive material is preferably a standard PTC material which conducts electrical current irrespective of the polarity of a voltage gradient applied across the busses 18 and 20. Such PTC material is well known for having a specific electric resistance of which rises with increasing temperature. The temperature coefficient indicates the increase in resistance per unit of temperature increase. A heating element having such a PTC characteristic self-regulates the heat that it emits. As an electrical current is caused to flow across the heating element, the temperature of the heating element rises. Due to the increasing resistance, the electrical current is reduced until equilibrium is reached.

The resistive layer comprises also a plurality of second individual patches 34 applied onto the substrate and onto selective conductive lines such as to provide electrical communication between at least selected ones of said alternating conductive lines and thereby between said first and second bus. In the shown embodiment, the patches 34 of the second material are located in a regular pattern between respective patches 32 of first material. It will be noted that this arrangement is not required for the operation of the heater element. Furthermore it is not a requirement that the patches 34 have the same size and/or shape nor that the patches 34 have the same size of shape than the first patches 32.

In contrast to the first patches, the second patches are configured as polarized heating patches. As illustrated in FIG. 1, the "polarized" patches 34 may e.g. comprises at least one diode 341 being connected in a series connection with the resistive material 342 between the first buss 18 and said second buss 24 or between respective selected ones of said alternating conductive lines. These "polarized" patches 34 conduct current only if the voltage gradient has the appropriate polarity. In case of opposite polarity, the diode 341 blocks the current to flow.

The heater 10 enables an easy implementation of three different states:

OFF: if both terminals of switch 16 are in their left position (as shown in FIG. 1) no voltage gradient is applied to the busses 18 and 20 and accordingly no current flows through the heater element. Accordingly no heat is generated.

LOW temp: if both terminals of switch 16 are in their middle position a voltage gradient of a first polarity is applied. In this state, a current flows through the patches 32 of the "standard" first PTC material and these patches 32 generate heat. The patches 34 of the polarized PTC material do not conduct the electrical current. Thus these patches 34 do not contribute to the heating.

HIGH temp: if both terminals of switch 16 are in their right position the polarity of the voltage gradient is reversed with respect to the LOW position. It follows that in this state the patches 34 also conduct the electrical current and accordingly contribute to the overall heat generation.

The invention claimed is:

1. A heater element for generating heat when connected to an electrical power source comprising an electrically insulating substrate, a buss layer made of a conductive material applied to said substrate, said first buss layer comprising a first buss and a second buss extending from respective first and second terminals in a terminal area of said heater element to a heating area of said heater element, and a resistive layer comprising at least one first patch of a first resistive material, said at least one first patch of said first resistive material being applied in a first selected location in said heating area such as to provide electrical communication between said first buss and said second buss and to enable an electrical current to flow through said first resistive material if a voltage gradient of a first polarity is applied across said first and second busses, wherein said resistive layer comprises at least one second patch of a second resistive material, said at least one second patch of said second resistive material being applied in a second selected location in said heating area such as to provide electrical communication between said first buss and said second buss, said second selected location being different from said first selected location, and wherein said at least one second patch of said second resistive material is configured as a polarized patch so as to enable an electrical current to flow through said second resistive material when a voltage gradient of a second polarity opposite to said first polarity is applied across said first and second busses and to block an electrical current to flow through said second resistive material when a voltage gradient of said first polarity is applied across said first and second busses.

2. The heater element according to claim 1, wherein said at least one second patch of said second resistive material comprises at least one diode being connected in a series connection with said resistive material between said first buss and said second buss.

3. The heater element according to claim 1, wherein said first buss and said second buss extend generally along opposite sides of said heating area and wherein a number of alternating conductive lines are electrically connected to opposite said first and second busses and extend between said first and second busses; and wherein said at least one first patch of said first resistive material and/or said at least one second patch of said second resistive material is/are applied in said heating area of said heater element such as to provide electrical communication between at least selected ones of said alternating conductive lines.

4. The heater element according to claim 1, wherein said resistive layer comprises a plurality of first patches of said first resistive material and/or a plurality of second patches of said second resistive material and wherein said plurality of first patches and/or said plurality of second patches is/are applied in said heating area of said heater element in such a way that said patches provide electrical communication between said first buss and said second buss.

5. The heater element according to claim 1, wherein said first resistive material has a first positive temperature coefficient (PTC) and/or said second resistive material has a second positive temperature coefficient (PTC).

6. An electrical heater comprising a heater element according to claim 1, an electrical power source operatively connectable to said first and second terminals of said first and second busses for applying a voltage gradient across said first and second busses, wherein said electrical power source is configured for operating in a first mode in which a voltage gradient of a first polarity is applied across said first and second busses and a second mode in which a voltage gradient of a second polarity opposite to said first polarity is applied across said first and second busses.

7. An electrical heater comprising a heater element according to claim 1, an electrical power source operatively connectable to said first and second terminals of said first and second busses for applying a voltage gradient across said first and second busses, and a switching element configured for reversing a polarity of said voltage gradient across said first and second busses.

* * * * *